US005221076A

United States Patent [19]

Züst

[11] Patent Number: 5,221,076

[45] Date of Patent: Jun. 22, 1993

[54] PROTECTIVE DEVICE AND METHOD OF INSTALLING PROTECTIVE DEVICE

[76] Inventor: Nico Züst, 18 rue des Légionnaires, 3780 Tétange, Luxembourg

[21] Appl. No.: 750,630

[22] Filed: Aug. 27, 1991

[30] Foreign Application Priority Data

Aug. 30, 1990 [LU] Luxembourg ..... 87793

[51] Int. Cl.[5] ..... E04H 17/08

[52] U.S. Cl. ..... 256/31; 256/1; 256/24; 256/DIG. 6; 248/237; 52/27; 182/113

[58] Field of Search ..... 256/DIG. 6, DIG. 2, 256/12.5, 13, 23, 73, 30, 31, 24, 29, 1; 182/137, 138, 139, 140, 113, 82; 248/237; 52/27

[56] References Cited

U.S. PATENT DOCUMENTS

| | | | |
|---|---|---|---|
| 156,049 | 10/1874 | Ward | 248/237 |
| 3,880,405 | 4/1975 | Brueske | 256/59 |
| 3,901,481 | 8/1975 | Probst | 256/59 |
| 4,666,131 | 5/1987 | Kettelkamp, Sr. et al. | 256/DIG. 6 X |
| 4,730,810 | 3/1988 | Rambaud | 256/35 X |

FOREIGN PATENT DOCUMENTS

| | | | |
|---|---|---|---|
| 667655 | 10/1938 | Fed. Rep. of Germany | 182/82 |
| 2522051 | 8/1983 | France | 256/12.5 |
| 273326 | 5/1951 | Switzerland | 182/99 |

*Primary Examiner*—Andrew V. Kundrat
*Assistant Examiner*—Harry C. Kim
*Attorney, Agent, or Firm*—Thomas S. Baker, Jr.

[57] ABSTRACT

The invention relates to a protective device adapted to be mounted at the base of a roof. The device has a set of posts each having a base section which locates in the gutter at the base of the roof and a fixing device linked to this base section, at least two arms being linked with a pair of posts, by upper parts and lower parts mounted on the posts, at least two bracing wires with each of these bracing wires being linked to one of the posts to connect it to a respective anchoring element located on the roof and a net connected to at least one of the arms and to two of the posts.

20 Claims, 2 Drawing Sheets

PROTECTIVE DEVICE AND METHOD OF INSTALLING PROTECTIVE DEVICE

BACKGROUND OF THE INVENTION

The present invention relates to a protective device for mounting at the base of a roof. More particularly, the invention relates to a protective system to prevent slaters or any other person working on a roof from falling off the roof.

DESCRIPTION OF PRIOR ART

Whether it be slaters or any person working on a building site, it is desirable for obvious reasons and within the framework of improving working conditions, to be able to limit the risks of occupational accident.

If one considers domestic dwelling and modern constructions with a sloping roof, persons working on the roof have little protection generally speaking and are therefore obliged to pay particular attention to ensure they do not fall off the roof.

As regards the construction of protective systems for mounting on a roof, the person skilled in the art is familiar with the use of structures with a timber framework fastened close to the eaves of the roof. Generally speaking, these structures are made of various planks attached to one another and arranged on the roof. However, these known structures can be criticized for being heavy and not very reliable. As far as timber structures are concerned, the assembly and dismantling of such protective systems takes up a lot of time. Furthermore, there are also problems as regards their use because these structures have large dimensions and are heavy. It is obvious, therefore, that there is a need for a protective system for mounting on a roof which enables the inadequacies encountered when using the aforementioned technique to be remedied to a large extent.

SUMMARY OF THE INVENTION

The object of the present invention is to provide a protective device which combines great ease of use with great reliability.

This object is achieved in that the protective device of the present invention is a combination of a set of posts comprising at least two lateral posts each having one base section which fits into a gutter at the base of a roof and a fastener linked to this base section, at least two arms comprising an upper arm and a lower arm, these arms being integral with the lateral posts by means of respective upper and lower sections fitted on the lateral posts, at least two bracing wires, each of these bracing wires being linked to one of the posts to connect it to a respective anchoring element located on the roof, and a net designed so that it can be connected to at least one of the arms and to the posts.

In accordance with the invention the protective device for persons working on a roof consists of locating a set of posts comprising at least two lateral posts in the gutter at the base of the roof, linking a fastening device to a base section of the lateral posts, securing at least two arms to the lateral posts using respective lower and upper sections mounted on the lateral posts, bracing at least two of the posts using bracing wires to connect them to a respective anchoring element located on the roof, and in connecting a net to at least one of the arms and to the lateral posts.

Advantageously, the arms can be rotatably mounted in relation to one of the lateral posts and mounted so that they can move in relation to the other lateral post so that the protective system can be folded up to facilitate its arrangement on the roof as well as transportation.

Further features and advantages of the present invention will emerge from the description which follows.

DESCRIPTION OF THE PREFERRED EMBODIMENT

Figure 1:
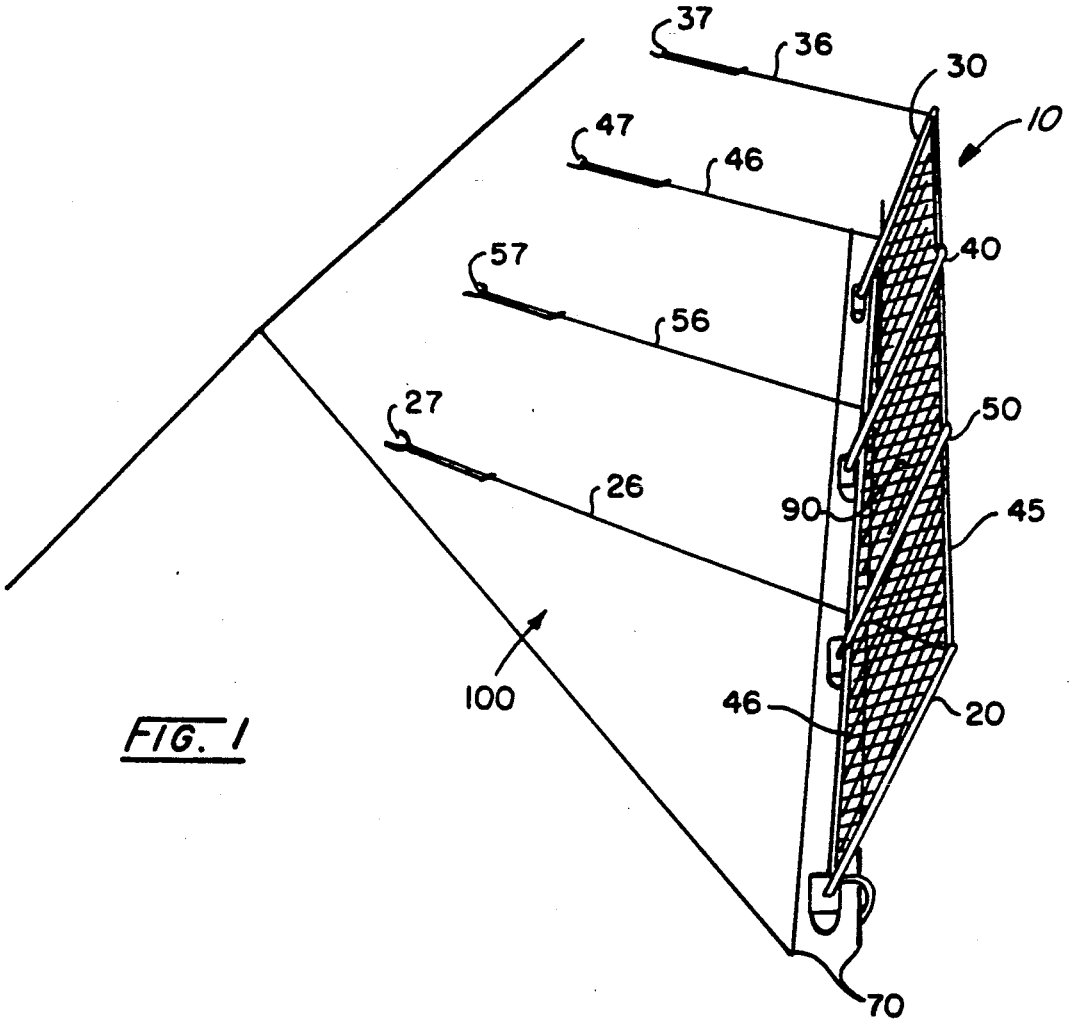
FIG. 1 s a perspective view of a protective device of the present invention in position on a roof.
Figure 2:
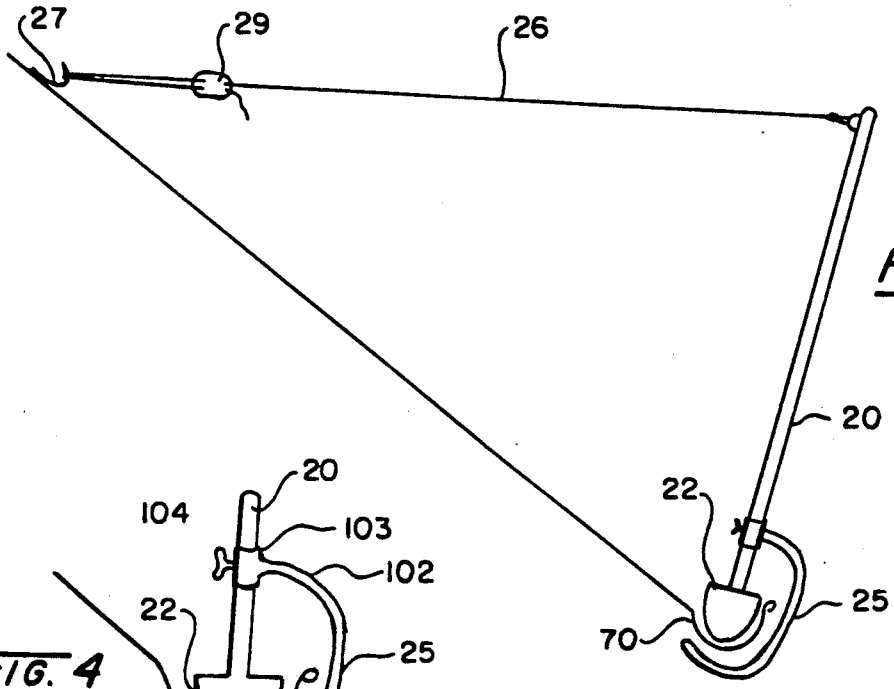
FIG. 2 is a lateral view of the protective device featured in FIG. 1.

Referring to FIG. 1, a preferred embodiment of the protective device of the present invention is disclosed. The protective device (10) is represented in position on a roof. The device (10) comprises several posts (20, 30, 40, and 50) designed to fit into a gutter (70) at the base of a roof (100). The posts (20, 30, 40 and 50) have a generally lateral orientation. Two arms (45 and 46) are movably attached to the two adjacent posts (20 and 30). Pairs of these arms (45 and 46) can also be attached to other pairs of posts (40 and 50). Furthermore, a net (90) is stretched between the posts (20 and 30) and the two arms (45 and 46). The device also comprises several bracing wires (26, 36, 46 and 56) which connects the posts (20, 30, 40 and 50) respectively to a respective anchoring element (27, 37, 47 and 57) located on the roof (100). Anchoring elements (27, 37, 47 and 57) of the type used generally for hooking roof ladders can be used advantageously for securely lashing the bracing wires (26, 36, 46 and 56) to roof (100).

As can be seen clearly in FIGS. and 2, the protective device of the invention is very reliable due, in particular, to the use of the bracing wires (26, 36, 46 and 56) which support the posts (20, 30, 40 and 50) and which are stretched in a transversal plane in relation to the plane containing the posts (20, 30, 40 and 50) in such a way as to ensure the stability of the protective device (10) in the event of large impacts on the net (90). The user can select the position for fixing bracing wires (26, 36, 46 and 56) on posts (20, 30, 40 and 50) so that they generally extend in a plane perpendicular to the plane containing posts (20, 30, 40 and 50) when the bracing wires are hooked to their respective anchoring elements (27, 37, 47 and 57). Furthermore, the user can adjust the gradient of the plane in which posts (20, 30, 40 and 50) extend and the net (90) in relation to the gradient of roof (100) across which is arranged the protective device (10) by selecting a sufficient space between the anchoring elements (27, 37, 47 and 57) and the fixing points of the bracing wires (26, 36, 46 and 56) respectively on the posts (20, 30, 40 and 50) and by using conventional fastening elements (29). The bracing wires (26, 36, 46 and 56) may be steel or nylon cables. As shown in detail in FIG. 4, a fixing device (25) is attached to the base section (22) of each of the posts (20, 30, 40 and 50). The base section (22) is adapted to fit into the existing roof gutter (70). Preferably a base section (22) having the shape of a shoe is used which generally fits the shape of gutter (70) and which is mounted on the relevant post (20). The shoe shaped base section (22) can be made or covered with rubber to prevent damage to the gutter (70) by the protective device (10) during impact or during assembly.

Figure 4:
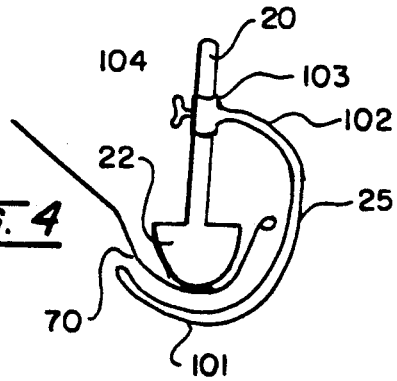
FIG. 4 is an enlarged, partial view of FIG. 2 illustrating the safety device linked to the base section of a post.

In the embodiment illustrated in FIG. 4, the fixing device (25) comprises a lower element (101) designed so that it adapts to the general shape of the outer surface of gutter (70). Furthermore, the fixing device (25) comprises an upper section (102) which enables the device (25) to be fixed to a corresponding post (20). In the embodiment illustrated, the upper section (102) comprises a collar (103) which defines a central opening having a size which enables it to receive a post (20) such that fixing device (25) can slide along the post (20). The upper section (102) also comprises a suitable blocking element (104) to enable the device (25) to be fixed in position. Butterfly nuts or other threaded fixing elements are particularly suitable for this blocking element (104).

In order to place the protective device (10) in position on the roof (100) the fixing device (25) is unscrewed and slid along post (20) to enable the base section (22) of post (20) to be introduced into the gutter (70). Once placed in position and correctly braced using bracing wire (26), the fixing device (25) linked to each of the other posts (30, 40 and 50) is fitted operationally on the gutter (70) and the lower element (101) placed at least in partial contact with gutter (70) beneath the gutter (70). After positioning the lower element (101) so that it is adjacent to gutter (70), the blocking element (104) is blocked to prevent the posts (20, 30, 40 and 50) from moving and from disengaging the gutter (70) particularly in the event of large impacts against net (90). Various shaped fixing devices (25) adapted to fit the various shapes of gutters (70), for example U-shaped gutter, can be utilized.

Figure 3:
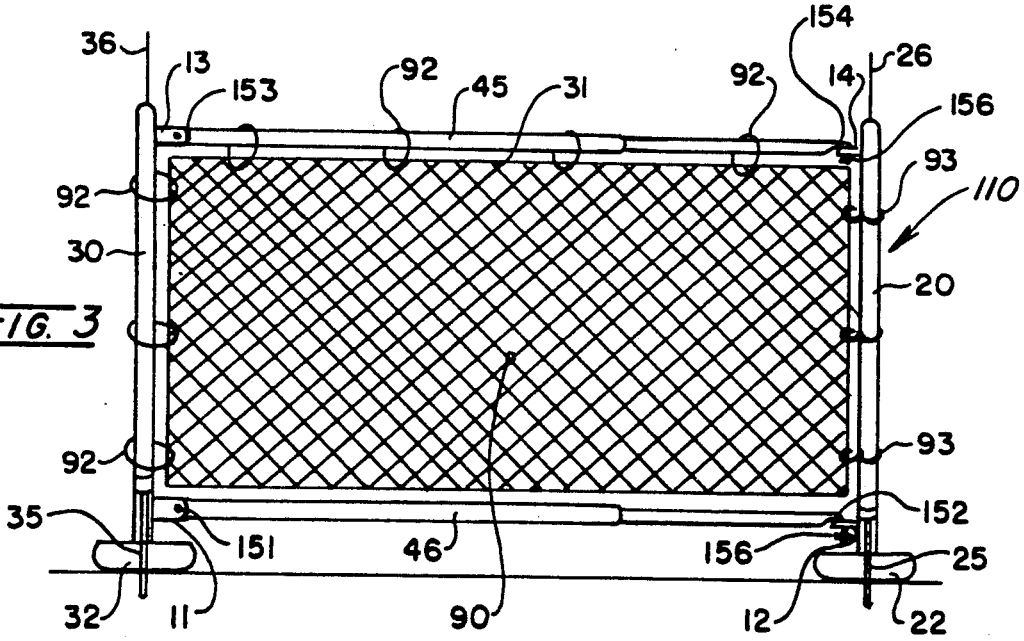
FIG. 3 is a front view of the protective device of FIG. 1.

In the embodiment of the invention illustrated in FIG. 3, a protective device (110) comprises two posts (20 and 30) and two arms (45 and 46) linked so that they cannot move in relation to posts (20 and 30). The posts can have a height of 1.3 meters and the length of the arms can be 2 meters when deployed.

A net (90) is stretched between posts (20 and 30) and arms (45 and 46). This net can take the form of a nylon net with a 4 to 6 centimeter mesh size.

Net (90) has an edge frame (91) to which are attached several support means (92 and 93) to support the net (90) in relation to the arms (45 and 46) and to the posts (20 and 30). The support means (92) are depicted as ropes which tie around at least one arm (45) and one post (30). In the embodiment shown in FIG. 3 the support means (93) are mounted on post (20) and are shown as having a hook shape adapted to receive the edge frame (91). As the result of the use of these hook shaped support means (93) the edge frame (91) can be disengaged and the whole of the net (90) folded up easily by sliding along arm (45) towards post (30) such that the equipment can be loaded and unloaded on the roof (70).

The posts (20 and 30) each have lower sections (11 and 12) and upper sections (13 and 14) to receive the extremities of arms (45 and 46). As illustrated schematically in FIG. 3, arms (45 and 46) may be telescopic tubes so that the dimensions of the protective device (110) can be increased parallel to the gutter (70) according to the needs of the user. Even though not shown, additional posts may be added between posts (20 and 30). These additional posts may be arranged downstream of the arms (45 and 46) in relation to the gradient of the roof, and may be braced as disclosed above. Additional posts are particularly useful when the telescopic arms (45 and 46) have been extended. Additional posts can serve to support effectively the central section of the protective device (110) upon impact.

In the position of use illustrated in FIG. 3, arms (45 and 46) are arranged perpendicular to posts (20 and 30). The arms (45 and 46) are rotatably mounted on a post (30) by upper and lower sections (13 and 11). For example, arms (45 and 46) can pivot around a bolt (151 and 153) inserted in an opening in upper and lower sections (13 and 11). Moreover, arms (46 and 46) are movably mounted on post (20) by suitable upper and lower sections (14 and 12). In particular, arms (45 and 46) can comprise hooked elements (154 and 152) which engage in an opening made in upper and lower sections (14 and 12). A conventional hasp (156) can be used as a safety element.

The embodiment of device (110) illustrated in FIG. 3 is particularly suited for multi-purpose use due to its adjustable length and the facility for pivoting arms (45 and 46) in relation to a post (30).

Arms (45 and 46) move from a folded position (not shown) in which they are generally located parallel to post (30) and are disconnected from post (20), to a position of use such as shown in FIG. 3 in which they extend perpendicular to posts (20 and 30) and are connected to post (20). Assembling and dismantling such device (110) is therefore very easy. In addition, this protective device (110) requires little space when in the folded position and is therefore easy to arrange on the roof or to transport.

Numerous variations will become obvious to those skilled in the art given the aforementioned description and attached drawings. For example, the posts of the protective device can be modified to ensure continuity between several protective systems which are placed side by side. Moreover, one or several of these adjustable devices can be dispensed with if a lower cost is required. These variations are disclosed purely on an informative basis.

I claim:

1. A protective device for mounting on a roof comprising at least two posts, each post having a base section adapted to be placed in a gutter of the roof at a selected distance from the other post and a fastening device linked to each base section adapted to be attached to said gutter, a first arm linked with the posts by respective sections mounted on the posts, a second arm linked with the posts by respective lower sections mounted on the posts, at least two bracing wires each being linked to one of the posts to link it with a respective anchoring element located on the roof, and net means linked to at least one of the first and second arms and to the posts.

2. The protective device according to claim 1, wherein the base section has a shoe shape which compliments a shape of the gutter.

3. The protective device according to claim 2, wherein the shoe is made covered with rubber.

4. The protective device according to claim 1, wherein each of the first and second arms rotatably mounted in relation to one of the posts.

5. The protective device according to claim 1 wherein the first and second arms pivot around a bolt inserted in an opening made in the upper and lower sections of one of the posts.

6. The protective device according to claim 1, wherein the first and second arms are mounted so that they can be moved in relation to one of the posts.

7. The protective device according to claim 1, wherein the first and second arms have hooked elements which engage in an opening formed in the upper and lower parts of one of the posts.

8. The protective device according to claim 1, wherein the first and second arms have telescoping tubes such that the length of the protective system is adjustable.

9. The protective device according to claim 1, further comprising anchoring elements adapted to be anchored onto the roof for attaching said bracing wires.

10. The protective device according to claim 1, wherein the fastening device comprises a lower section which complements the shape of the gutter and an upper section to enable it to be fixed in position on the post.

11. The protective device according to claim 10 wherein the upper section comprises a collar which defines a central opening to receive a post and an associated blocking element.

12. The protective device according to claim 1, further comprising support means attached to said first and second arms and wherein the net means is connected by said support means to the first and second arms and to the posts to support the net means relative thereto.

13. The protective device according to claim 1 wherein the net means has an edge frame at its perimeter.

14. The protective device according to claim 13 further comprising support means mounted on one of the posts and where said support means comprise a hook to receive the edge frame of the net means.

15. A method of installing a protective device on a roof for protecting persons working on the roof comprising the steps of:

locating a base section of at least two posts in a gutter of the roof, linking a fixing device with the base section of the posts, linking at least two arms to the posts using respective lower and upper sections mounted on the posts, bracing at least two of the posts by bracing wires to connect them to a respective anchoring element located on the roof, and connecting a net to at least one of the arms and to the posts.

16. The method according to claim 15, wherein the bracing wires are lashed to anchoring elements anchored onto the roof.

17. The method according to claim 15 including adjustment means for adjusting the length of said bracing wires to make the gradient of the plane in which the posts extend adjustable in relation to the gradient of the roof.

18. The method according to claim 15 wherein the gutter is clamped between the base section of the posts and a lower section of the fixing device.

19. The method according to claim 15 wherein the arms are pivoted in relation to the posts in order to move from a folded position where they are arranged generally parallel in relation to one of the posts to a position of use where they are arranged perpendicular in relation to the posts.

20. The method according to claim 15 wherein the net may be unhooked in relation to one of the posts to enable the net to be folded up by sliding along the arms.

* * * * *